US008286446B2

(12) United States Patent
Howard et al.

(10) Patent No.: US 8,286,446 B2
(45) Date of Patent: Oct. 16, 2012

(54) METHOD AND APPARATUS FOR SEPARATING AIR

(75) Inventors: Henry Edward Howard, Grand Island, NY (US); Richard John Jibb, Amherst, NY (US); Kirk Frederick Larson, Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 1169 days.

(21) Appl. No.: 12/116,547

(22) Filed: May 7, 2008

(65) Prior Publication Data

US 2009/0277220 A1 Nov. 12, 2009

(51) Int. Cl.
*F25J 3/00* (2006.01)

(52) U.S. Cl. ..... 62/646; 62/640; 62/644; 62/648; 62/643

(58) Field of Classification Search ..... 62/643, 62/646, 651, 656, 647, 648, 650
See application file for complete search history.

(56) References Cited

U.S. PATENT DOCUMENTS

| | | | | |
|---|---|---|---|---|
| 3,327,489 | A * | 6/1967 | Gaumer, Jr. | 62/650 |
| 3,754,406 | A * | 8/1973 | Allam | 62/646 |
| 4,208,199 | A | 6/1980 | Nakazato et al. | |
| 4,410,343 | A | 10/1983 | Ziemer | |
| 4,769,055 | A | 9/1988 | Erickson | |
| 5,006,139 | A | 4/1991 | Agrawal et al. | |
| 5,337,570 | A * | 8/1994 | Prosser | 62/646 |
| 5,551,258 | A * | 9/1996 | Rathbone | 62/646 |
| 5,611,219 | A | 3/1997 | Bonaquist | |
| 5,644,933 | A * | 7/1997 | Rathbone | 62/646 |
| 5,873,264 | A | 2/1999 | Bonaquist et al. | |
| 6,009,723 | A * | 1/2000 | Fidkowski et al. | 62/649 |
| 2007/0209389 | A1 * | 9/2007 | Prosser | 62/643 |
| 2008/0223077 | A1 * | 9/2008 | Prosser et al. | 62/646 |

FOREIGN PATENT DOCUMENTS

| | | |
|---|---|---|
| JP | 8-296961 | 11/1996 |

* cited by examiner

*Primary Examiner* — Frantz Jules
*Assistant Examiner* — Keith Raymond
(74) *Attorney, Agent, or Firm* — David M. Rosenblum

(57) ABSTRACT

Method and apparatus of separating an oxygen and nitrogen containing feed stream, for example, air, in higher and lower pressure columns. A crude liquid oxygen stream condenses nitrogen vapor in the higher pressure column for reflux purposes and results in the partial vaporization of the crude liquid oxygen stream to produce vapor and liquid fractions thereof. The liquid fraction condenses a lower pressure part of the feed stream and results in the liquid fraction being at least partially vaporized. Both the vapor fraction of the crude liquid oxygen stream and the liquid fraction after having been at least partially vaporized are introduced into the lower pressure column. Boil-up is produced within a bottom region of the lower pressure column by partially vaporizing an oxygen-rich liquid column bottoms against condensing a higher pressure part of the feed stream and then utilizing vapor or residual liquid as an oxygen product.

16 Claims, 1 Drawing Sheet

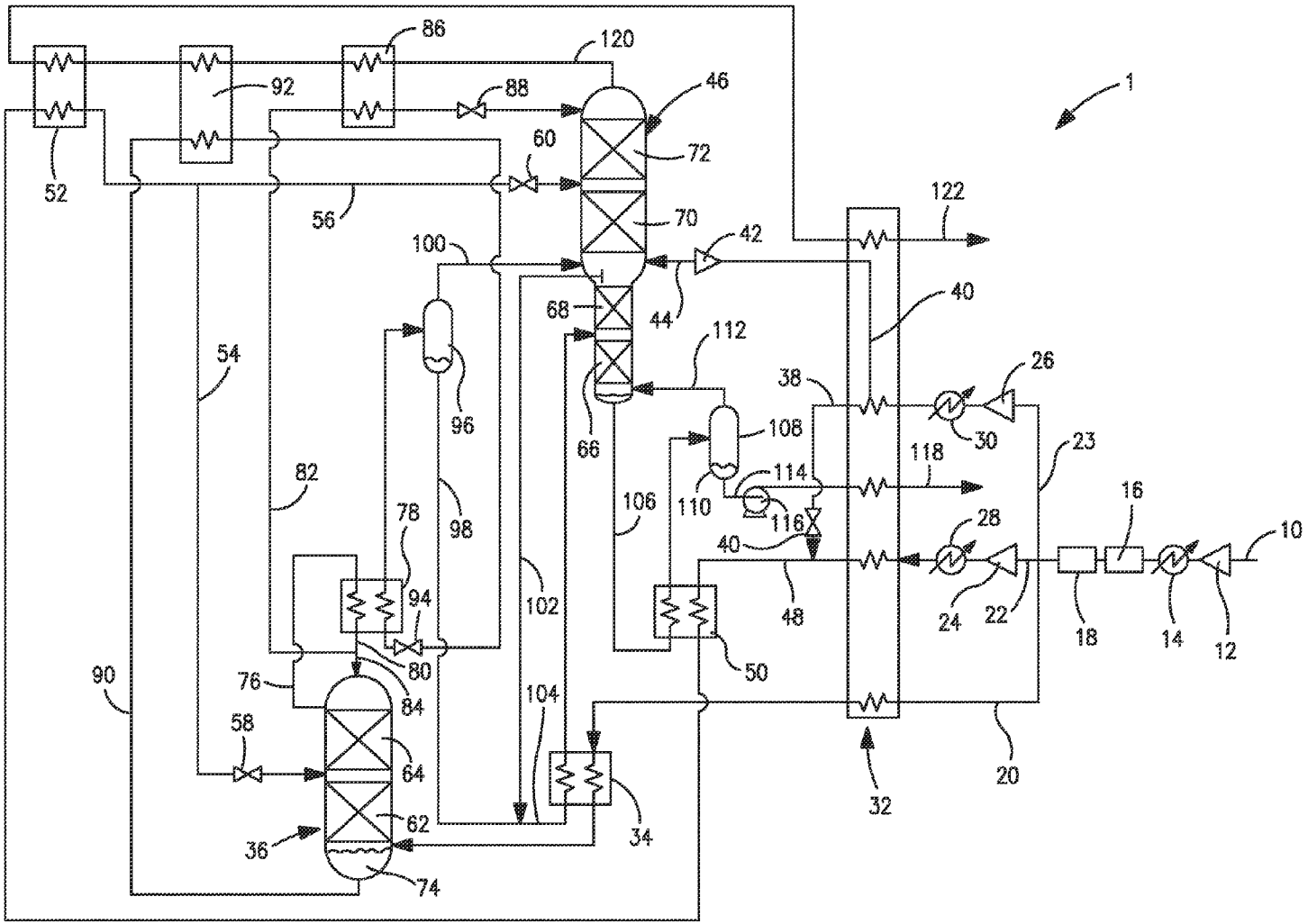
1
10
12
14
16
18
20
22
23
24
26
28
30
32
34
36
38
40
42
44
46
48
50
52
54
56
58
60
62
64
66
68
70
72
74
76
78
80
82
84
86
88
90
92
94
96
98
100
102
104
106
108
110
112
114
116
118
120
122

METHOD AND APPARATUS FOR SEPARATING AIR

FIELD OF THE INVENTION

The present invention relates to a method and apparatus for separating an oxygen and nitrogen containing stream, for example, air, utilizing a higher pressure column and a lower pressure column in which lower pressure column reboil is produced at two or more locations. More particularly, the present invention relates to such a method in which a portion of the feed air is substantially condensed to produce reboil at the bottom of the lower pressure column, another portion of the air, which is fed at lower pressure, provides low pressure column reboil above that produced by the portion of the air fed to produce the bottom reboil and at least both feed air streams are, at least in part, distilled in the higher pressure column.

BACKGROUND OF THE INVENTION

In recent developments related to the generation of electrical power, oxygen is used in the gasification of coal and in oxy-fuel combustion. The oxygen is typically generated in an air separation plant by the cryogenic rectification of air. The air separation plant requires the air be compressed and therefore, it is desirable that such energy expenditure be as small as possible to maximize the amount of electrical power that is available for uses outside of the plant.

Cryogenic air separation plants typically employ a higher pressure column and a lower pressure column. The incoming air is compressed and introduced into the higher pressure column. The feed air is rectified to produce a nitrogen-rich overhead and a crude liquid oxygen column bottoms. The oxygen-rich column bottoms liquid is further refined in the lower pressure column to produce an oxygen-rich liquid that is reboiled against condensing the nitrogen-rich overhead produced in the higher pressure column. The condensation of the nitrogen-rich overhead produces nitrogen-rich liquid that is used to reflux both the higher pressure column and the lower pressure column. Some of the nitrogen-rich liquid can be taken as a product.

Given such thermal linkage between the higher pressure column and the lower pressure column, the operational pressure of the higher pressure column has to be set so that the oxygen-rich liquid is able to condense the nitrogen-rich vapor of the higher pressure column. This being said, the actual power consumed is strongly dependent upon how effectively energy/vapor flow is introduced into the lower sections of the lower pressure column in which nitrogen is stripped from the descending oxygen-rich liquid. In the production of low purity oxygen, that would be of use in oxy-coal combustion and gasification cycles, the performance of the nitrogen stripping section is far from ideal resulting in inefficiency and therefore an opportunity to reduce air separation power consumption.

In a conventional double column unit the feed air is compressed within a relatively fixed range. The higher pressure column and the lower pressure column are thermally coupled such that high pressure column overhead/nitrogen reboils the bottom of low pressure column. U.S. Pat. No. 5,551,258 discloses an air separation method producing low purity oxygen in which the higher pressure column overhead and the base of the lower pressure column are effectively decoupled. In one embodiment, air is compressed to successively higher pressures to produce a higher pressure air stream and a lower pressure air stream. The higher pressure air stream reboils the bottom of the lower pressure column and the lower pressure column stream reboils an intermediate location of the nitrogen stripping section of the lower pressure column. Both of these streams are thereby liquefied or at the very least, substantially condensed and introduced into the higher pressure column for rectification. A stream of crude liquid oxygen from the higher pressure column is subcooled and then partially vaporized against condensing some of the reflux required for the higher pressure column. The resulting vaporized crude liquid oxygen is phase separated and the liquid and vapor phases are introduced into successively higher portions of the lower pressure column rather than in the nitrogen stripping section.

As can be appreciated, intermediate reboilers present in the lower pressure column represent an expense because the lower pressure column must necessarily be made taller to accommodate the reboilers. Additionally, adding the crude liquid oxygen directly into the upper portions of the lower pressure column does not increase the efficiency of the nitrogen stripping section. In fact, additional mixing irreversibility is incurred through this direct introduction.

As will be discussed, the present invention provides a method and apparatus for the production of low purity oxygen which is less expensive to fabricate than the prior art and further improves the efficiency of the stripping section of the lower pressure column.

SUMMARY OF THE INVENTION

The present invention provides a method of producing an oxygen product from the feed stream comprising oxygen and nitrogen. In accordance with the method, a first part of the feed stream is partially condensed and a stream made up, at least in part, of a second part of the feed stream is condensed. The partial condensation of the first part and the substantial condensation of the second part occurs after the first part of the feed stream has been compressed, the second part of the feed stream has been compressed to a higher pressure than that of the first part of the feed stream and the first part of the feed stream and the second part of the feed stream are cooled within a main heat exchange zone. The first part of the feed stream is condensed and introduced into the higher pressure column of a distillation column system. Liquid that results from the condensation of the stream made up, at least in part, of the second part of the feed stream is rectified within the higher pressure column and a lower pressure column of the distillation column system.

A first crude liquid oxygen stream primarily composed of a crude liquid oxygen column bottoms of the higher pressure column is partially vaporized through indirect heat exchange with a nitrogen-rich stream composed of nitrogen-rich column overhead produced in the higher pressure column, thereby producing a liquid nitrogen containing stream. The liquid nitrogen containing stream is utilized as reflux to the higher pressure column and the lower pressure column.

Liquid and vapor phases are disengaged from the first crude liquid oxygen stream, after having been partially vaporized, to form a crude oxygen vapor stream and a second crude liquid oxygen stream. An oxygen containing stream that is made up, at least in part, of the second crude liquid oxygen stream is passed in indirect heat exchange with the first part of the feed stream. This affects the condensation of the first part of the feed stream and at least partially vaporizes the oxygen containing stream. The crude oxygen vapor stream is introduced along with the oxygen containing stream, after having been at least partially vaporized, into successively lower points than the lower pressure column. It is to be noted, that the introduction of the oxygen containing stream may be introduced as a single stream into the lower pressure column or alternatively, vapor and liquid fractions may be disengaged and introduced as two separate streams into the lower pressure column. As used herein and in the claims, the term, "introduction" when used in connection with the introduction of the oxygen containing stream into the lower pressure column is therefore, meant to cover both possibilities.

Boil-up is produced within a bottom portion of the lower pressure column by at least partially vaporizing an oxygen-rich liquid column bottoms produced within the lower pressure column by indirect heat exchange with the stream, made up at least in part, of the second part of the feed stream. This effects the condensation of the stream made up at least in part of the second part of the feed stream. The oxygen product stream is formed from either residual liquid or vapor produced from the at least partial vaporization of the oxygen-rich liquid column bottoms stream.

An oxygen and nitrogen containing liquid stream can be withdrawn from the lower pressure column at a point of introduction of the crude oxygen vapor stream. The oxygen and nitrogen containing liquid stream can be combined with a second crude liquid oxygen stream to form the oxygen containing stream. The oxygen-rich liquid column bottoms can be partially vaporized within a heat exchanger located outside of the lower pressure column. Boil-up vapor is disengaged from the residual liquid contained in the oxygen-rich liquid column bottoms after having been partially vaporized. A boil-up vapor stream is introduced into the bottom region of the lower pressure column to produce the boil-up and a stream of the residual liquid is utilized as the oxygen product stream.

The oxygen product stream can be pumped and vaporized within the main heat exchange zone. The first part of the feed stream is compressed to a first pressure and the second part of the feed stream is compressed to a second pressure higher than that of the first pressure. A third part of the feed stream can be further compressed to a third pressure higher than the second pressure and introduced into the main heat exchange zone to effect the vaporization of the oxygen product stream after having been pumped. A first portion of the third part of the feed stream is withdrawn from the main heat exchange zone after having been partially cooled and expanded within a turboexpander to produce an exhaust stream that is in turn introduced into the lower pressure column. A second portion of the third part of the feed stream can be fully cooled and liquefied within the main heat exchange zone and expanded to the second pressure to allow its combination with the second part of the feed stream.

The liquid nitrogen containing stream can be divided into a first part and a second part. The first part of the liquid nitrogen containing stream refluxes the lower pressure column and the second part of the liquid nitrogen containing stream refluxes the higher pressure column. A nitrogen product stream that is composed of nitrogen containing column overhead of the lower pressure column can be used to subcool the second part of the liquid nitrogen containing stream, the first crude liquid oxygen column bottoms stream and the stream made up, at least in part, of the second part of the feed stream after having been condensed through indirect heat exchange therewith. The stream made up, at least in part, of the second part of the feed stream after having been subcooled can be divided into first and second subsidiary streams. The first crude liquid oxygen column bottoms stream, the second part of the liquid nitrogen containing stream and the first and second subsidiary streams can each be expanded. The first and second subsidiary streams are then respectively introduced into the higher pressure column and the lower pressure column. The nitrogen product stream is introduced into the main heat exchange zone and fully warmed.

In any embodiment, the first part of the feed stream and the second part of the feed stream can be compressed to the first pressure and the second pressure, respectively, by compressing the feed stream in a first compressor and purifying the feed stream of higher boiling contaminants. The feed stream after having been purified is divided into the first part of the feed stream and the second part of the feed stream. The second part of the feed stream can be compressed in a second compressor. Additionally, the third part of the feed stream can be compressed in a third compressor.

In another aspect, the present invention provides an apparatus for producing an oxygen product from a feed stream comprising oxygen and nitrogen. In accordance with this aspect of the present invention, a first compressor is provided to compress a first part of the feed stream to a first pressure and a second compressor is employed to compress a second part of the feed stream to a second pressure. The second pressure is greater than the first pressure.

A main heat exchange zone is in flow communication with the first compressor and the second compressor and is configured to cool the first part of the feed stream and the second part of the feed stream through indirect heat exchange with return streams produced from cryogenic rectification of air. The return streams include an oxygen product stream composed of the oxygen product.

A first heat exchanger is interposed between the main heat exchange zone and a higher pressure column of a distillation column system comprising the higher pressure column and a lower pressure column. The first heat exchanger is configured to partially condense the first part of the feed stream through indirect heat exchange with an oxygen containing stream formed at least in part from a second crude liquid oxygen stream. This at least partially vaporizes the oxygen containing stream. The first heat exchanger is connected to the higher pressure column so as to introduce the first part of the feed stream after having been partially condensed within the first heat exchanger into the higher pressure column.

A second heat exchanger is provided in flow communication with the main heat exchange zone and the lower pressure column of the distillation column system. The second heat exchanger is configured to condense a stream made up at least in part of the second part of the feed stream through indirect heat exchange with an oxygen-rich liquid column bottoms stream composed of an oxygen-rich liquid column bottoms produced within the lower pressure column. The heat exchange at least partially vaporizes the oxygen-rich liquid column bottoms stream. The second heat exchanger is in flow communication with the higher pressure column and the lower pressure column so as to introduce first and second portions of the stream made up at least in part of second part of the feed stream, after condensation in the second heat exchanger, into the higher pressure column and the lower pressure column, respectively. This rectifies liquid resulting from the substantial condensation.

A third heat exchanger is connected to the high pressure distillation column and is configured to partially vaporize a first crude liquid oxygen stream primarily composed of crude liquid oxygen column bottoms produced in the higher pressure column through indirect heat exchange with a nitrogen-rich stream composed of nitrogen-rich column overhead produced in the higher pressure column. This produces a liquid nitrogen containing stream. The third heat exchanger is also in flow communication with both the higher pressure column and the lower pressure column so that the lower pressure column is refluxed with a first part of the liquid nitrogen containing stream and the higher pressure column is refluxed with a second part of the liquid nitrogen containing stream.

A phase separator is connected to the third heat exchanger so as to disengage liquid and vapor phases from the first crude liquid oxygen stream after having been partially vaporized to form a crude oxygen vapor stream and the second crude liquid oxygen stream. The phase separator and the first heat exchanger are also connected to the lower pressure column of the distillation column system such that the crude oxygen vapor stream and the oxygen containing stream after having been at least partially vaporized are introduced into successively lower points in the lower pressure column. The second heat exchanger is also in flow communication with the lower pressure column such that boil-up is produced within a bottom portion of the lower pressure column through at least partial vaporization of an oxygen-rich liquid bottoms stream. The second heat exchanger is also in flow communication with the main heat exchange zone such that the oxygen product stream is formed from residual liquid or vapor produced from the at least partial vaporization of the oxygen-rich liquid column bottoms and is introduced into the main heat exchange zone.

A first conduit can be connected to the lower pressure column such that an oxygen and nitrogen containing stream is withdrawn from the lower pressure column at a point of introduction of the crude oxygen vapor stream. A second conduit can be connected between the phase separator and the first heat exchanger and connected to the first conduit such that the oxygen and nitrogen containing stream is combined with the second crude liquid oxygen stream upstream of the first heat exchanger so as to form the oxygen containing stream.

The phase separator can be a first phase separator. A second phase separator can be connected to the second heat exchanger to disengage boil-up vapor from the residual liquid contained in the oxygen-rich liquid column bottoms stream after having been at least partially vaporized. The second phase separator is connected to the bottom region of the lower pressure column so that a boil-up vapor stream is introduced into the bottom region of the lower pressure column to produce the boil-up. The second phase separator is also in flow communication with the main heat exchange zone so as to introduce a stream of the residual liquid into the main heat exchange zone and thereby to form the oxygen product stream.

A pump can be positioned to pressurize the oxygen product stream. The pump is connected to the main heat exchange zone so that the oxygen product stream after having been pressurized is vaporized within the main heat exchange zone. A third compressor can be connected to the main heat exchange zone to compress a third part of the feed stream to a third pressure, higher than the second pressure, to effect the vaporization of the oxygen product stream after having been pumped. The main heat exchange zone is configured such that a first portion of the third part of the feed stream is discharged from the main heat exchange zone after having been partially cooled. An expander can be connected to the main heat exchange zone so that the first portion of the third part of the feed stream is expanded, thereby to produce an exhaust stream. The expander is also connected to the lower pressure column so that the exhaust stream is introduced into the lower pressure column. The main heat exchange zone is also configured such that a second portion of the third part of the feed stream is fully cooled and liquefied within the main heat exchange zone. An expansion device can be connected to the main heat exchange zone and in flow communication with the second heat exchange such that the second portion of the third part of the feed stream is expanded to the second pressure and combined with the second part of the feed stream upstream of the second heat exchanger.

A subcooling unit can be connected to a top portion of the lower pressure column, the second heat exchanger, the higher pressure column and the third heat exchanger. The subcooling unit is configured such that a nitrogen product stream composed of a nitrogen-rich containing column overhead of the lower pressure column subcools the second part of the nitrogen containing liquid stream, the first crude liquid oxygen column bottoms stream and a stream made up, at least in part, of the second part of the feed stream after having been condensed. The subcooling unit is also in flow communication with the higher and the lower pressure columns such that the stream made up, at least in part of the second part of the feed stream after having been subcooled is divided into first and second subsidiary streams and introduced into the higher and lower pressure columns. First and second expansion valves can be interposed between the subcooling unit and the higher and lower pressure columns to expand the first and second subsidiary streams to the higher column pressure and the lower column pressure, respectively. The subcooling unit is also connected to the main heat exchange zone such that the nitrogen product stream is introduced into the main heat exchange zone and fully warmed.

A purification unit can be connected to the first compressor to purify the feed stream of higher boiling contaminants. The second compressor can be connected to the purification unit such that the feed stream, after having been purified, is divided into the first part of the feed stream and the second part of the feed stream to be compressed in the second compressor.

A third compressor can also be connected to the purification such that the feed stream, after having been purified, is also divided into a third part of the feed stream and the third part of the feed stream is compressed in the third compressor.

BRIEF DESCRIPTION OF THE DRAWING

While the specification concludes with claims distinctly pointing out the subject matter that Applicants regard as their invention, it is believed that the invention will be better understood when taken in connection with the sole FIGURE that illustrates a schematic view of an air separation plant for carrying out a method in accordance with the present invention.

DETAILED DESCRIPTION

With reference to FIG. 1, an apparatus 1 is illustrated separating air or other oxygen and nitrogen containing stream to produce an oxygen product in accordance with the present invention. Apparatus 1 is designed to produce a low purity oxygen product namely, a product having an oxygen purity of between about 90 percent and about 98.5 percent. As will be discussed, reboil is provided within the lower pressure column by condensation of portions of the feed air. As a result, the low purity oxygen product has a higher concentration of argon than would exist in a distillation column unit in which high pressure column overhead/nitrogen reboils the bottom of low pressure column.

In accordance with the illustrated embodiment a feed stream 10 that comprises of oxygen and nitrogen, for instance air. A first compressor 12 is provided as a base load air compressor to compress the feed stream 10 to a pressure in a range from between about 2.5 bara and about 3.0 bara. The first air compressor 12 may comprise multiple stages of compression and/or intercooling. After compression, feed air stream 10 is further cooled in an after cooler 14 near ambient temperatures. Thereafter, feed stream 10 can be further cooled in a refrigerated after cooler 16 which may comprise a direct contact cooler or heat exchanger, either of which may use combinations of ambient and/or chilled water to absorb the heat of compression and to reduce the moisture content of the compressed air.

The resultant compressed and cooled feed stream 10 can be purified within a prepurification unit 18 to remove higher boiling contaminants such as moisture, carbon dioxide and hydrocarbons. As well known in the art, prepurification unit typically contains beds of alumina and/or molecular sieve operating in accordance with a temperature and/or pressure swing adsorption cycle in which moisture and other higher boiling impurities are adsorbed. While one bed is operating, another bed is regenerated.

The feed stream 10 after having been compressed and purified is divided into a first part 20, a second part 22 and a third part 23. The second part 22 of feed stream 10 is compressed in a second compressor 24 and the third part 23 of feed stream 10 is compressed in a third compressor 26. Second compressor 24 can compress second part 22 of feed stream 10 to a pressure of between about 4 and about 4.5 bara. Third compressor 26 compresses third part 23 of feed stream 10 to a yet even higher pressure. Second compressor 24 and third compressor 26 can each comprise multiple stages of compression with intercooling between stages.

First part 20 of feed stream 10 and second part 22 of feed stream 10 and third part 23 of feed stream 10, after removal of heat of compression by after coolers 28 and 30, respectively, are introduced into a main heat exchanger 32. As can be appreciated, it is possible to separately compress each of the aforesaid streams. First part 20 of feed stream 10 is cooled to near saturation in main heat exchanger 32 and exits near its saturation temperature. Such stream is then partially condensed within a heat exchanger 34. A typical exit vapor fraction is in a range of between about 75 percent and about 95 percent. The resultant partially condensed stream is then introduced into a higher pressure column 36 to serve as the primary gaseous feed to said column. As can be appreciated, after the partial condensation the first part 20 of feed stream 10 could be phase separated and the respected vapor and liquid fractions could be fed independently into higher pressure column 36.

It is to be noted that since first part 20 of feed stream 10 constitutes the major portion of the feed to apparatus 1, energy is saved that would otherwise be expended in compression because such stream is not compressed any further. Moreover, since the pressure to which such stream is compressed is much lower than that of a conventional distillation column unit additional energy savings are achieved.

Third part 23 of feed stream 10 after having been further compressed, is preferably partially cooled within main heat exchanger 32 and divided into a first fraction 38 and a second fraction 40. Second fraction 40 is thus partially cooled and can be introduced into a turboexpander 42 to produce an exhaust stream 44 that is introduced into a lower pressure column 46. As used herein and in the claims, the term "partially cooled" means cooled to a temperature between the warm and cold ends of main heat exchanger 32. It is to be noted that refrigeration can be generated in a number of ways. In the illustrated embodiment, upper column air expansion is used. However, a portion of nitrogen-rich stream 76, to be discussed, could be expanded for similar purposes. Other known methods could be used. Further, the shaft work of expansion can be used in a number of ways, for example, booster air compression or to drive a variable or fixed speed generator. The resulting power may be employed for other compression, pumping or exported for distribution.

Although not illustrated, compressors 24 and 26 could be integrated. These compression stages may be integrated into a single machine with a combined motor. Alternatively, the compression may be integrated into the base load compressor 12. All of the compression stages may be driven off of the same motor. For very large plant applications, it may be advantageous to compress two separate streams, for example, second part 22 of feed stream 10 and third part 23 of feed stream 10 may be compressed independently of first part 20 of feed stream 10. In this arrangement it may be advantageous to employ separate pre-purification units 18. Each compression train would possess its own cooling and pretreatment means.

First fraction 38 is fully cooled. It serves to vaporize a pumped liquid oxygen stream to be discussed and as such, in the illustrated embodiment is liquefied. First fraction 38 is thereupon reduced in pressure by an expansion valve 40 and combined with second part 22 feed stream 10 to produce a combined stream 48 that is condensed within a heat exchanger 50. The resultant condensed combined stream 48 is then passed through a subcooling unit 52 and divided into a first portion 54 and a second portion 56. First portion 54 is expanded within an expansion valve 58 to a pressure compatible with that of higher pressure column 36 and introduced into an intermediate location thereof. Second portion 56 is expanded by an expansion valve 60 and introduced into the lower pressure column 46.

Higher pressure column 36 and lower pressure column 46 are so called because higher pressure column 36 operates at a higher pressure than lower pressure column 46. Both columns contain mass transfer contacting elements such as structured packing, random packing or sieve trays. With respect to higher pressure column 36, structured packing elements 62 and 64 are illustrated. As to lower pressure column 46, structured packing elements 66, 68, 70 and 72 are illustrated. The introduction of first part 20 of feed stream 10 into higher pressure column 36 along with first fraction 54 of combined stream 48 produces an ascending vapor phase and a descending liquid phase within higher pressure column 36. The ascending vapor phase becomes ever more rich in the lower boiling or more volatile components as it ascends and the liquid phase becomes ever more rich in the higher boiling components to produce a crude liquid oxygen column bottoms 74 and a nitrogen-rich column overhead.

Part of the nitrogen-rich column overhead is extracted as a nitrogen-rich stream 76 that is condensed within a heat exchanger 78 to produce a liquid nitrogen containing stream 80. A first part 82 of the liquid nitrogen containing stream 80 is used to reflux the lower pressure column 46 and a second part 84 of liquid nitrogen containing stream 80 is used to reflux the higher pressure column 36. First part 82 of liquid nitrogen containing stream 80 is subcooled within a subcooling unit 86 and then is reduced in pressure by an expansion valve 88 prior to its introduction into lower pressure column 46 as reflux.

A first crude liquid oxygen stream 90 composed of the crude liquid oxygen column bottoms 74 is subcooled within a subcooling unit 92 and is then reduced in pressure and temperature by an expansion valve 94. First crude liquid oxygen stream is then passed through heat exchanger 78 to condense the nitrogen-rich stream 76. This partially vaporizes first crude liquid oxygen stream 90 that has a vapor fraction in a range of between about 70 percent and about 90 percent. Liquid and vapor phases are disengaged from the first crude liquid oxygen stream 90 after the partial vaporization thereof in a phase separator 96. This disengagement produces a second crude liquid oxygen stream 98 and a crude oxygen vapor stream 100. Crude oxygen vapor stream 100 is introduced into the lower pressure column 46.

An oxygen and nitrogen containing liquid stream 102 can be withdrawn from the lower pressure column 46 at a liquid collection point at or near the introduction of crude oxygen vapor stream 100 and then combined with second crude liquid oxygen stream 98 to produce a oxygen containing stream 104. Although not specifically illustrated, a first conduit would lead from the liquid collection point of the lower pressure column and merge with a second conduit leading from the phase separator 96. A mechanical pump (not shown) may be employed for this purpose (if the coldbox layout dictates its need). However, this is optional and oxygen containing stream 104 could be made up entirely of second crude liquid oxygen stream 98.

Oxygen containing stream 104 is introduced into heat exchanger 34 to partially condense first part 20 of feed stream 10 resulting in partial vaporization of the oxygen containing stream 104. An embodiment of the present invention is possible in which the heat exchange stream 104 is fully vaporized. In any case of a partial vaporization, at least about 50 percent vaporization of heat exchange stream 104 is possible. However, a vaporization of between about 70 percent and about 90 percent is preferred. Oxygen containing stream 104 is thereafter introduced into lower pressure column 72 below the point of introduction of crude oxygen vapor stream 100 to strip nitrogen from the descending liquid phase within the lower pressure column 46.

Boil-up is produced within lower pressure column 46 by partially vaporizing an oxygen-rich liquid column bottoms stream 106 through indirect heat exchange with combined stream 48 within heat exchanger 50. The boil-up vapor is disengaged from residual liquid contained within the oxygen-rich liquid column bottoms stream 106 within a phase separator 108 to produce residual liquid 110 and a boil-up vapor stream 112 that is reintroduced into the bottom region of lower pressure column 46. It is understood, however, that in a possible embodiment of the present invention, oxygen-rich liquid column bottoms stream 106 could be fully vaporized. The residual liquid stream 114 is pumped within a pump 116 and then fully vaporized within main heat exchanger 32 to produce oxygen product stream 118. Another possibility is to produce a product stream from vaporized oxygen.

It is to be noted that the vaporization of pumped liquid oxygen is optional. When oxygen at pressure is required, the pumped liquid oxygen produced by pumping residual liquid stream 114 may be warmed and vaporized within a segregated product boiler-vessel or within designated exchanger passes integrated into the main heat exchanger 32. In this regard, the term, "main heat exchange zone" is used herein and in the claims to encompass a segregated product boiler vessel, a single main heat exchanger 32 as illustrated and also, in which warm and cold ends thereof are separate units. In a preferred embodiment, all of the heat exchangers 34, 50 and 78 operate in a "once-through" fashion. In particular, the boiling fluid proceeds through exchanger only once. At least the vapor fraction is then directed into the column system (as opposed to a recirculated boiler/thermo-siphon). In the design of brazed aluminum heat exchangers, it is known in the art to combine heat exchangers into a single package. For example, such a method may be employed in the integration of heat exchangers 78 and 50 or alternatively, heat exchangers 34 and 50. In addition, the subject exchanger may be incorporated with the associated phase separator 96 or 108.

Alternatively, the use of falling film (i.e. down flow) evaporators may be employed to reduce the respective temperature approaches on the various heat exchangers 34, 50 and 78. The use of a down flow evaporator is of particular utility to heat exchanger 78. Since the nitrogen condenses at essentially constant pressure and temperature, the exchanger approach is independent of flow direction (there is no thermodynamic penalty for employing a down flow exchanger in such a service). In the case of down flow evaporation, the preferred flow path/direction is likely to be co-current—oxygen-rich fluid boils in the same direction in which the condensing stream flows. It should be noted that down flow evaporators may optionally employ a small recirculation pump for purposes of maintaining full wetting of the heat exchange surface.

There are a numerous options with respect to the design and operation of the various heat exchangers 34, 50 and 78. For instance, the heat exchanger 34 may alternatively employ a stream of liquid taken from the liquid collector located just above the point of introduction of crude oxygen vapor stream 100. This stream of liquid may be combined with stream second crude liquid oxygen stream 98 before or after heat exchanger 78. Such an approach may be advantageous from the standpoint of controlling condenser operation and maintaining a fixed level of evaporation within exchanger 78. In this regard, generally the exit vapor fraction of heat exchanger 78 will be in a range of between about 70 percent and about 90 percent.

A nitrogen product stream 120 composed of the nitrogen containing column overhead from lower pressure column 46 is then passed sequentially into heat exchange unit 86, heat exchange unit 92 and heat exchange unit 52 to subcool the second part 82 of the nitrogen containing liquid stream, the first crude liquid oxygen column bottoms stream 90 and the combined stream 48, respectively. Nitrogen product stream 120 is thereafter fully warmed within the main heat exchanger 32 to produce a warm nitrogen product stream 122. It is to be noted that a portion, typically about 15 percent of nitrogen product stream 120 could be used in facilitating the regeneration of adsorbent beds within prepurification unit 16.

In order to further reduce the power consumption of the process, the pressure of lower pressure column 46 may be further reduced to near ambient. In order to generate sufficient pressure within the portion of nitrogen product stream 120 that is used in part for the regeneration of adsorbent beds, a regeneration blower may be employed to boost the pressure of such portion, approximately, 3 psi. As the column pressure is reduced the respective K-values increase facilitating the separation of air. In such instances, an increased fraction of air may be directed to the heat exchanger 34 in which partial condensation occurs to thereby further lower cycle power consumption.

In many instances there will be a need for higher purity nitrogen. In such instances, a top-hat (extra column staging) may be incorporated into the higher and/or the lower pressure columns 36 and 46 in order to generate high purity nitrogen that contains less than 10 ppm oxygen. Such an adaptation may be introduced independent of the changes necessary to implement the subject invention.

To illustrate the operation of the subject invention a process simulation of the illustrated embodiment is shown in the table below. The process simulation includes oxygen containing stream 104 being made up of both second crude liquid oxygen stream 98 and oxygen and nitrogen containing liquid stream 102. It is to be noted that the respective flows have been normalized to the total coldbox air flow, namely feed stream 10.

TABLE

| Stream | Flow Fraction | Vapor Fraction | Pressure Bara | Temperature C. | Mole Fraction Nitrogen | Argon | Oxygen |
|---|---|---|---|---|---|---|---|
| Exhaust stream 44 | 0.0365 | 1.000 | 1.34 | −180.2 | 0.7811 | 0.0093 | 0.2095 |
| Oxygen and nitrogen containing liquid stream 102 | 0.0771 | 0.000 | 1.34 | −187.7 | 0.3843 | 0.0261 | 0.5896 |
| Oxygen containing stream 104 after heat exchanger 34 | 0.1575 | 0.800 | 1.35 | −184.4 | 0.3937 | 0.0217 | 0.5846 |
| First crude liquid oxygen stream 90 after heat exchanger 78 | 0.4703 | 0.829 | 1.34 | −187.9 | 0.6618 | 0.0134 | 0.3249 |
| First fraction 38 of third part 23 of feed stream 10 | 0.2800 | 0.000 | 5.97 | −175.4 | 0.7811 | 0.0093 | 0.2095 |
| Nitrogen product stream 120 | 0.7859 | 1.000 | 1.31 | −193.3 | 0.9879 | 0.0042 | 0.0079 |
| Oxygen-rich liquid column bottoms stream 106 | 0.3488 | 0.386 | 1.35 | −180.9 | 0.0432 | 0.0327 | 0.9241 |
| Residual Liquid stream 114 | 0.2141 | 0.000 | 1.35 | −180.9 | 0.0218 | 0.0282 | 0.9500 |
| First part 20 of feed stream 10 after main heat exchanger 32 | 0.5260 | 1.000 | 2.60 | −177.8 | 0.7811 | 0.0093 | 0.2095 |
| First part 20 of feed stream 10 after heat exchanger 34 | 0.5260 | 0.767 | 2.56 | −183.4 | 0.7811 | 0.0093 | 0.2095 |
| first part 82 of the liquid nitrogen containing stream 80 | 0.2773 | 0.000 | 2.49 | −187.1 | 0.9835 | 0.0025 | 0.0140 |
| Second part 22 of feed stream 10 after main heat exchanger 32 | 0.1575 | 0.970 | 3.95 | −177.7 | 0.7811 | 0.0093 | 0.2095 |
| Combined stream 48 after heat exchanger 50 | 0.4375 | 0.000 | 3.92 | −180.1 | 0.7811 | 0.0093 | 0.2095 |
| First portion 54 of condensed combined stream 48 | 0.2216 | 0.000 | 3.92 | −183.7 | 0.7811 | 0.0093 | 0.2095 |

While the present invention has been described with reference to a preferred embodiment, as will occur to those skilled in the art, numerous changes, additions and omissions can be made without departing from the spirit and scope of the present invention as set forth in the appended claims.

We claim:

1. A method of producing an oxygen product from a feed stream comprising oxygen and nitrogen, said method comprising:

partially condensing a first part of the feed stream and condensing a stream made up, at least in part, of a second part of the feed stream after the first part of the feed stream has been compressed, the second part of the feed stream has been compressed to a higher pressure than that of the first part of the feed stream and the first part of the feed stream and the second part of the feed stream are cooled within a main heat exchange zone;

introducing said first part of the feed stream into a higher pressure column of a distillation column system;

rectifying liquid resulting from the condensation of the stream made up, at least in part of the second feed stream in the higher pressure column and a lower pressure column of the distillation column system;

partially vaporizing a first crude liquid oxygen stream primarily comprised of crude liquid oxygen column bottoms produced in the higher pressure column through indirect heat exchange with a nitrogen-rich stream composed of nitrogen-rich column overhead produced in the higher pressure column, thereby producing a liquid nitrogen containing stream utilized as reflux to the higher pressure column and the lower pressure column;

disengaging liquid and vapor phases from the first crude liquid oxygen stream after having been partially vaporized to form a crude oxygen vapor stream and a second crude liquid oxygen stream;

passing an oxygen containing stream made up at least in part of the second crude liquid oxygen stream in indirect heat exchange with the first part of the feed stream, thereby to effect the partial condensation of the first part of the feed stream and to at least partially vaporize the oxygen containing stream;

introducing the crude oxygen vapor stream, as a vapor and the oxygen containing stream, after having been at least partially vaporized, into successively lower points in the lower pressure column and such that oxygen containing stream is introduced below the crude oxygen vapor stream;

producing boil-up within a bottom portion of the lower pressure column by at least partially vaporizing an oxygen-rich liquid column bottoms produced within the lower pressure column by indirect heat exchange with the stream made up at least in part from second part of the feed stream, thereby effectuating the substantial condensation thereof;

and forming an oxygen product stream from either residual liquid or vapor produced from the at least partial vaporization of the oxygen-rich liquid column bottoms.

2. The method of claim 1, wherein:

an oxygen and nitrogen containing liquid stream is withdrawn from the lower pressure column at a point of introduction of the crude oxygen vapor stream; and the oxygen and nitrogen containing liquid stream is combined with the second crude liquid oxygen stream to form the oxygen containing stream.

3. The method of claim 1, wherein:

the oxygen-rich liquid column bottoms is partially vaporized within a heat exchanger located outside of the lower pressure column;

boil-up vapor is disengaged from the residual liquid contained in the oxygen-rich liquid column bottoms after having been partially vaporized;

a boil-up vapor stream is introduced into the bottom region of the lower pressure column to produce the boil-up; and the oxygen product stream is formed from a stream of the residual liquid.

4. The method of claim 1, wherein:

the oxygen product stream is pumped and vaporized within the main heat exchange zone;

the first part of the feed stream is compressed to a first pressure and the second part of the feed stream is compressed to a second pressure higher than that of the first pressure;

a third part of the feed stream is further compressed to a third pressure, higher than the second pressure, and introduced into the main heat exchange zone to effect the vaporization of the oxygen product stream after having been pumped;

a first portion of the third part of the feed stream is withdrawn from the main heat exchange zone after having been partially cooled and expanded within a turboexpander to produce an exhaust stream that is in turn introduced into the lower pressure column;

a second portion of the third part of the feed stream is fully cooled and liquefied within the main heat exchange zone, expanded to the second pressure and combined with the second part of the feed stream.

5. The method of claim 4, wherein:

the oxygen-rich liquid column bottoms is partially vaporized within a heat exchanger located outside of the lower pressure column;

boil-up vapor is disengaged from the residual liquid contained in the oxygen-rich liquid column bottoms after having been partially vaporized;

a boil-up vapor stream is introduced into the bottom region of the lower pressure column to produce the boil-up; and a stream of the residual liquid is utilized as the oxygen product stream.

6. The method of claim 4, wherein:

the liquid nitrogen containing stream is divided into a first part and a second part;

the first part of the liquid nitrogen containing stream refluxes the lower pressure column and the second part of the liquid nitrogen containing stream refluxes the higher pressure column;

a nitrogen product stream composed of a nitrogen containing column overhead of the lower pressure column subcools the second part of the liquid nitrogen containing stream, the first crude liquid oxygen column bottoms stream and the stream made up, at least in part, of the second part of the feed stream after having been condensed through indirect heat exchange therewith;

the stream made up at least in part from the second part of the feed stream after having been subcooled is divided into first and second subsidiary streams;

the first crude liquid oxygen column bottoms stream, the second part of the liquid nitrogen containing stream and the first and second subsidiary streams are each expanded;

the first and second subsidiary stream are respectively introduced into the higher pressure column and the lower pressure column; and the nitrogen product stream is introduced into the main heat exchange zone and fully warmed.

7. The method of claim 4, wherein the first part of the feed stream and the second part of the feed stream are compressed to the first pressure and the second pressure, respectively, by:

compressing the feed stream in a first compressor and purifying the feed stream of higher boiling contaminants;

dividing the feed stream, after having been purified, into the first part of the feed stream and the second part of the feed stream; and compressing the second part of the feed stream in a second compressor.

8. The method of claim 4, wherein the first part of the feed stream, the second part of the feed stream and the third part of the feed stream are compressed to the first pressure, the second pressure and the third pressure, respectively, by:

compressing the feed stream in a first compressor and purifying the feed stream of higher boiling contaminants;

dividing the feed stream, after having been purified, into the first part of the feed stream, the second part of the feed stream and the third part of the feed stream;

compressing the second part of the feed stream in a second compressor; and compressing the third part of the feed stream in a third compressor.

9. An apparatus for producing an oxygen product from a feed stream comprising oxygen and nitrogen, said apparatus comprising:

a first compressor to compress a first part of the feed stream to a first pressure and a second compressor to compress a second part of the feed stream to a second pressure, the second pressure being greater than the first pressure;

a main heat exchange zone in flow communication with the first compressor and the second compressor configured to cool the first part of the feed stream and the second part of the feed stream through indirect heat exchange with return streams produced from cryogenic rectification of air and including an oxygen product stream composed of the oxygen product;

a first heat exchanger interposed between the main heat exchange zone and a higher pressure column of a distillation column system comprising the higher pressure column and a lower pressure column, the first heat exchanger configured to partially condense the first part of the feed stream through indirect heat exchange with an oxygen containing stream formed at least in part from a second crude liquid oxygen stream, thereby to at least partially vaporize the oxygen containing stream, the first heat exchanger connected to the higher pressure column so as to introduce the first part of the feed stream after having been partially condensed within the first heat exchanger into the higher pressure column;

a second heat exchanger in flow communication with the main heat exchange zone and the lower pressure column of the distillation column system and configured to condense a stream made up at least in part of the second part of the feed stream through indirect heat exchange with an oxygen-rich liquid column bottoms stream composed of an oxygen-rich liquid column bottoms produced in the lower pressure column, thereby to at least partially vaporize the oxygen-rich liquid column bottoms stream;

the second heat exchanger in flow communication with the higher pressure column and the lower pressure column so as to introduce first and second portions of the stream made up at least in part of the second part of the feed stream, after condensation in the second heat exchanger, into the higher pressure column and the lower pressure column, respectively, thereby to rectify liquid resulting from the substantial condensation thereof;

a third heat exchanger connected to the higher pressure distillation column and configured to partially vaporize a first crude liquid oxygen stream primarily comprised of crude liquid oxygen column bottoms produced in the higher pressure column through indirect heat exchange with a nitrogen-rich stream composed of nitrogen-rich column overhead produced in the higher pressure column, thereby producing a liquid nitrogen containing stream;

the third heat exchanger also in flow communication with both the higher pressure column and the lower pressure column so that the lower pressure column is refluxed with a first part of the liquid nitrogen containing stream and the higher pressure column is refluxed with a second part of the liquid nitrogen containing stream;

a phase separator connected to the third heat exchanger so as to disengage liquid and vapor phases from the first crude liquid oxygen stream after having been partially vaporized to form a crude oxygen vapor stream and the second crude liquid oxygen stream;

the phase separator and the first heat exchanger also connected to the lower pressure column of the distillation column system such that the crude oxygen vapor stream, as a vapor and the oxygen containing stream after having been at least partially vaporized are introduced into successively lower points in the lower pressure column and such that oxygen containing stream is introduced below the crude oxygen vapor stream; and the second heat exchanger also in flow communication with the lower pressure column such that boil-up is produced within a bottom portion of the lower pressure column through the at least partial vaporization of an oxygen-rich liquid column bottoms stream and in flow communication with the main heat exchange zone such that the oxygen product stream is formed from residual liquid or vapor produced from the at least partial vaporization of the oxygen-rich liquid column bottoms stream and introduced into the main heat exchange zone.

10. The apparatus of claim 9, wherein:

a first conduit connected to the lower pressure column such that an oxygen and nitrogen containing stream is withdrawn from the lower pressure column at a point of introduction of the crude oxygen vapor stream; and a second conduit connected between the phase separator and the first heat exchanger and connected to the first conduit such that the oxygen and nitrogen containing stream is combined with the second crude liquid oxygen stream upstream of the first heat exchanger to form the oxygen containing stream.

11. The apparatus of claim 9, wherein:

the phase separator is a first phase separator;

a second phase separator is connected to the second heat exchanger to disengage boil-up vapor from the residual liquid contained in the oxygen-rich liquid column bottoms stream after having been partially vaporized;

the second phase separator connected to the bottom region of the lower pressure column so that a boil-up vapor stream is introduced into the bottom region of the lower pressure column to produce the boil-up; and the second phase separator also in flow communication with the main heat exchange zone to introduce a stream of the residual liquid into the main heat exchange zone, thereby to form the oxygen product stream.

12. The apparatus of claim 9, wherein:

a pump is positioned to pressurize the oxygen product stream, the pump connected to the main heat exchange zone so that the oxygen product stream after having been pressurized is vaporized within the main heat exchange zone;

a third compressor connected to the main heat exchange zone to compress a third part of the feed stream to a third pressure, higher than the second pressure to effect the vaporization of the oxygen product stream after having been pumped;

the main heat exchange zone is configured such that a first portion of the third part of the feed stream is discharged from the main heat exchange zone after having been partially cooled;

an expander is connected to the main heat exchange zone so that the first portion of the third part of the feed stream is expanded, thereby to produce an exhaust stream, the expander also being connected to the lower pressure column so that the exhaust stream is introduced into the lower pressure column;

the main heat exchange zone also configured such that a second portion of the third part of the feed stream is fully cooled and liquefied within the main heat exchange zone, and an expansion device is connected to the main heat exchange zone and in flow communication with the second heat exchanger such that the second portion of the third part of the feed stream is expanded to the second pressure and combined with the second part of the feed stream upstream of the second heat exchanger.

13. The apparatus of claim 12, wherein:

the phase separator is a first phase separator;

a second phase separator is connected to the second heat exchanger to disengage boil-up vapor from the residual liquid contained in the oxygen-rich liquid column bottoms stream after having been partially vaporized;

the second phase separator is connected to the bottom region of the lower pressure column so that a boil-up vapor stream is introduced into the bottom region of the lower pressure column to produce the boil-up; and the second phase separator is also in flow communication with the main heat exchange zone to introduce a stream of the residual liquid into the main heat exchange zone, thereby to form the oxygen product stream.

14. The apparatus of claim 12, wherein:

a subcooling unit is connected to the top portion of the lower pressure column, the second heat exchanger, the higher pressure column and the third heat exchanger and configured such that a nitrogen product stream composed of a nitrogen containing column overhead of the lower pressure column subcools the second part of the nitrogen containing liquid stream, the first crude liquid oxygen column bottoms stream and the stream made up, at least in part, of the second part of the feed stream after having been condensed;

the subcooling unit also in flow communication with the higher and the lower pressure columns such that the stream made up, at least in part, of the second part of the feed stream after having been subcooled is divided into first and second subsidiary streams and introduced into the higher and lower pressure columns;

first and second expansion valves interposed between the subcooling unit and the higher and the lower pressure column to expand the first and second subsidiary stream to the higher pressure column pressure and the lower pressure column pressure, respectively; and the subcooling unit also connected to the main heat exchange zone such that the nitrogen product stream is introduced into the main heat exchange zone and fully warmed.

15. The apparatus of claim 9, wherein:

a purification unit is connected to the first compressor to purify the feed stream of higher boiling contaminants; and the second compressor is connected to the purification unit such that the feed stream, after having been purified, is divided into the first part of the feed stream and the second part of the feed stream is compressed in the second compressor.

16. The apparatus of claim 12, wherein the third compressor is also connected to the purification unit such that the feed stream, after having been purified is also divided into the third part of the feed stream and the third part of the feed stream is compressed in the third compressor.

* * * * *